US005120048A

United States Patent [19]

Aikens

[11] Patent Number: 5,120,048

[45] Date of Patent: Jun. 9, 1992

[54] DEWRINKLER PLATEN BELT

[75] Inventor: Andrew J. Aikens, Webster, N.Y.

[73] Assignee: Xerox Corporation, Stamford, Conn.

[21] Appl. No.: 744,053

[22] Filed: Aug. 12, 1991

[51] Int. Cl.[5] ..... B65H 5/02

[52] U.S. Cl. ..... 271/275; 271/198; 198/847

[58] Field of Search ..... 271/275, 198, 34; 198/847

[56] References Cited

U.S. PATENT DOCUMENTS 4,179,215 12/1979 Hage ..... 271/4
4,185,908 1/1980 Taylor et al. ..... 271/275
4,267,921 5/1981 Kell ..... 198/847
4,449,627 5/1984 Kell ..... 198/847
4,919,409 4/1990 Stemmle ..... 271/275

*Primary Examiner*—H. Grant Skaggs
*Assistant Examiner*—Steven M. Reiss
*Attorney, Agent, or Firm*—Ronald F. Chapuran

[57] ABSTRACT

Sheet handling apparatus for transporting sheets to and from a flat surface comprising an endless belt movably supported around at least two support members to define a belt transport run across and parallel to said flat surface, said endless belt having a top and bottom layer of flexible material, and a layer of tubes sandwiched between the top layer and the bottom layer, the layer of tubes interlocking along a predetermined plane to provide rigidity to the belt transport in a first direction and flexibility to the belt transport in a second direction.

3 Claims, 4 Drawing Sheets

DEWRINKLER PLATEN BELT

BACKGROUND OF THE INVENTION

The invention relates to a platen belt, and more particularly, to a platen belt for flattening documents contained thereon.

In order to increase the throughput and other reproducing capabilities it is common practice to use document handlers with automatic electrostatographic reproducing apparatus. The document handlers are used to separate individual documents from a stack of documents to be copied, move them on to the viewing platen where they are registered, held until the required number of copies have been made and then moved onto an output collection point to be followed by successive documents in the stack. Such an automatic document handler must not only move the document but must accurately register it in a predetermined copying position to assure production of a complete and visually acceptable copy. If, for example, the document is situated on the platen in a skewed or misaligned position, the copy will reflect the same skew or misalignment. Furthermore, it must also be capable of accepting a maximum range of paper weights or material weights efficiently as documents copied may have to vary from very heavy papers to very light papers such as those known as onion skin. Typically document handlers that have been used in the prior art include those employing a wide friction belt to transport the documents across the viewing platen.

A difficulty with the prior art belts is that the flexibility required of the belts to be driven around supporting rolls prevents the belts from holding documents flat that may be wrinkled, pleated, bent, or folded. If the document does not lay flat on the platen glass, portions of the document may be outside the depth of focus of the system optics. This will result in out of focus and blurred images.

It would be desirable to overcome the small tolerances for depth of focus in prior art systems. It is an object, therefore of the present invention to provide a platen belt that is able to compensate for wrinkled, pleated, bent, or folded documents. It is another object of the present invention to provide a platen belt that is flexible in the direction to rotate around supporting rolls and yet is rigid in the direction to press and flatten wrinkled, pleated, bent, or folded documents onto the platen glass. Other objects and advantages of the invention will become apparent as the following description proceeds and the features of the invention will be set forth with particularly in the claims annexed to and forming a part of this specification.

SUMMARY OF THE INVENTION

Briefly, the present invention is concerned with sheet handling apparatus for transporting sheets to and from a flat surface comprising an endless belt movably supported around at least two support members to define a belt transport run across and parallel to the flat surface, the endless belt having a top and bottom layer of flexible material, and a layer of tubes sandwiched between the top layer and the bottom layer, the layer of tubes interlocking along a predetermined plane to provide rigidity to the belt transport in a first direction and flexibility to the belt transport in a second direction.

For a better understanding of the present invention, reference may be had to the accompanying drawings wherein the same reference numerals have been applied to like parts and wherein:

DETAILED DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE PREFERRED EMBODIMENT

Figure 1:
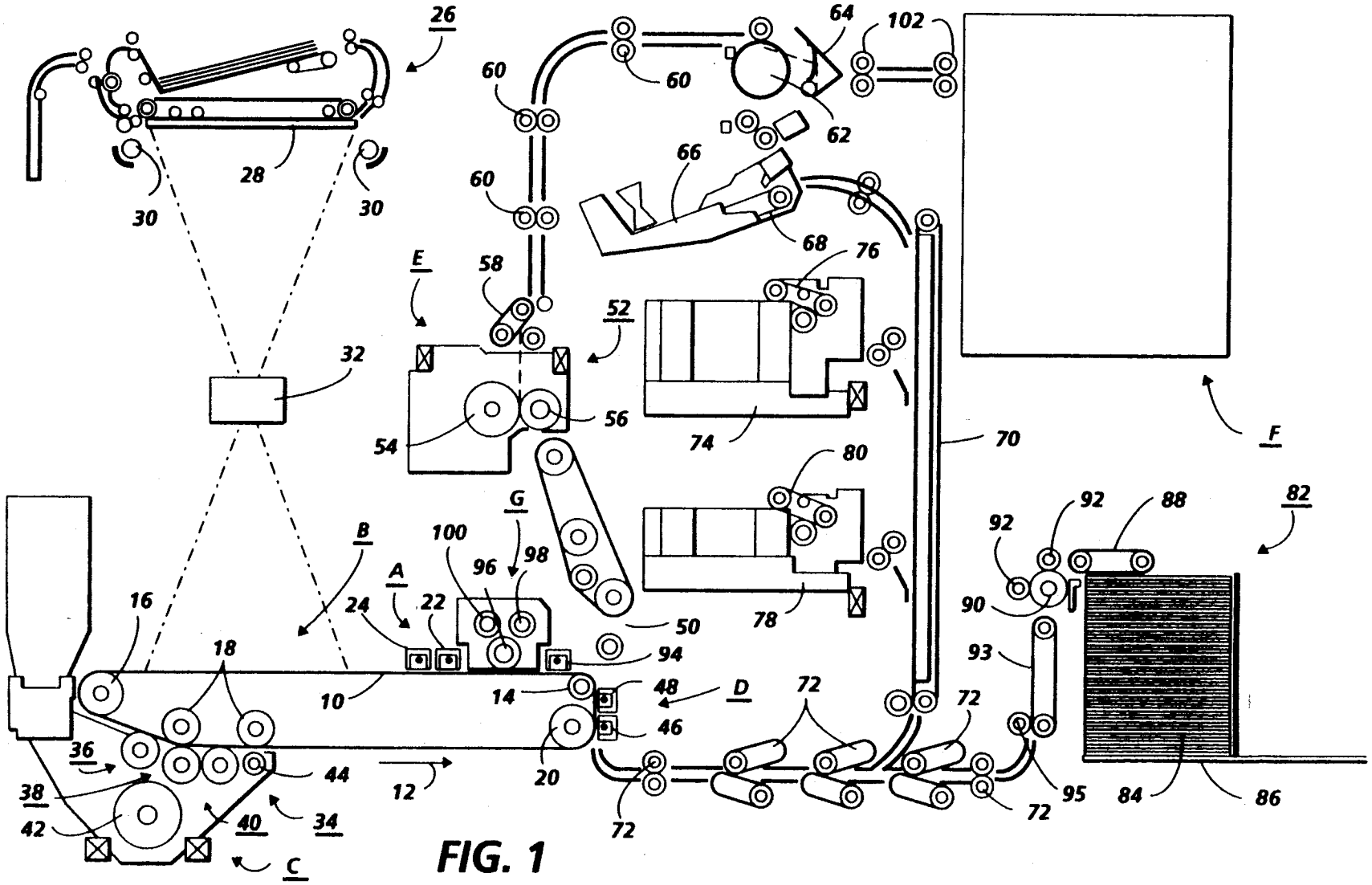
FIG. 1 is a schematic elevational view depicting various operating components and sub-systems of the machine shown in FIG. 1.
Figure 2:
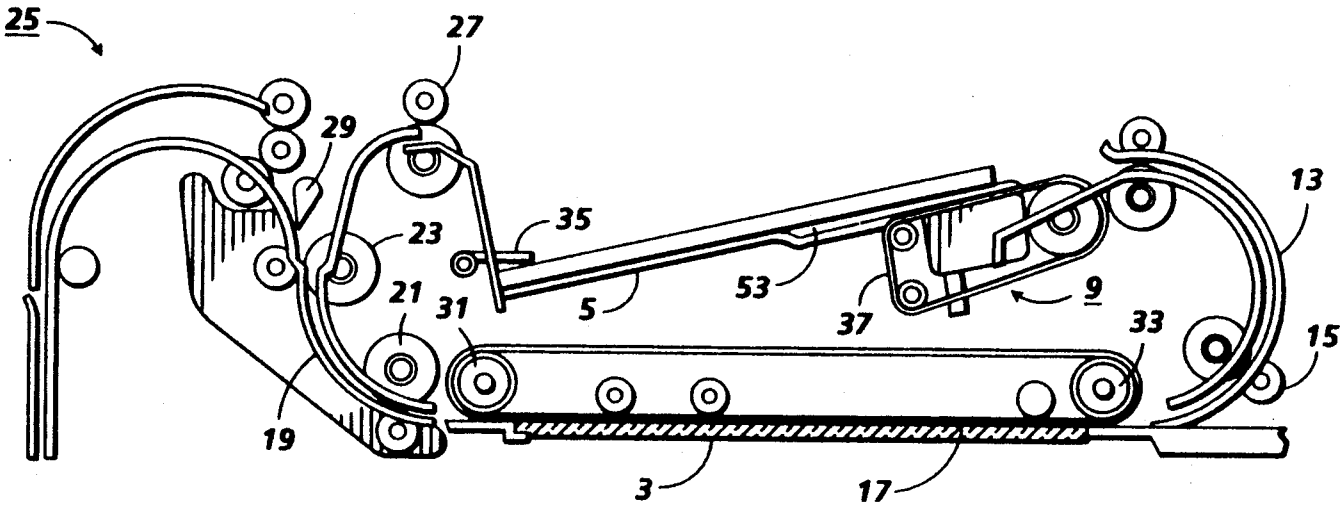
FIG. 2 is an enlarged view of the document handler.
Figure 3:
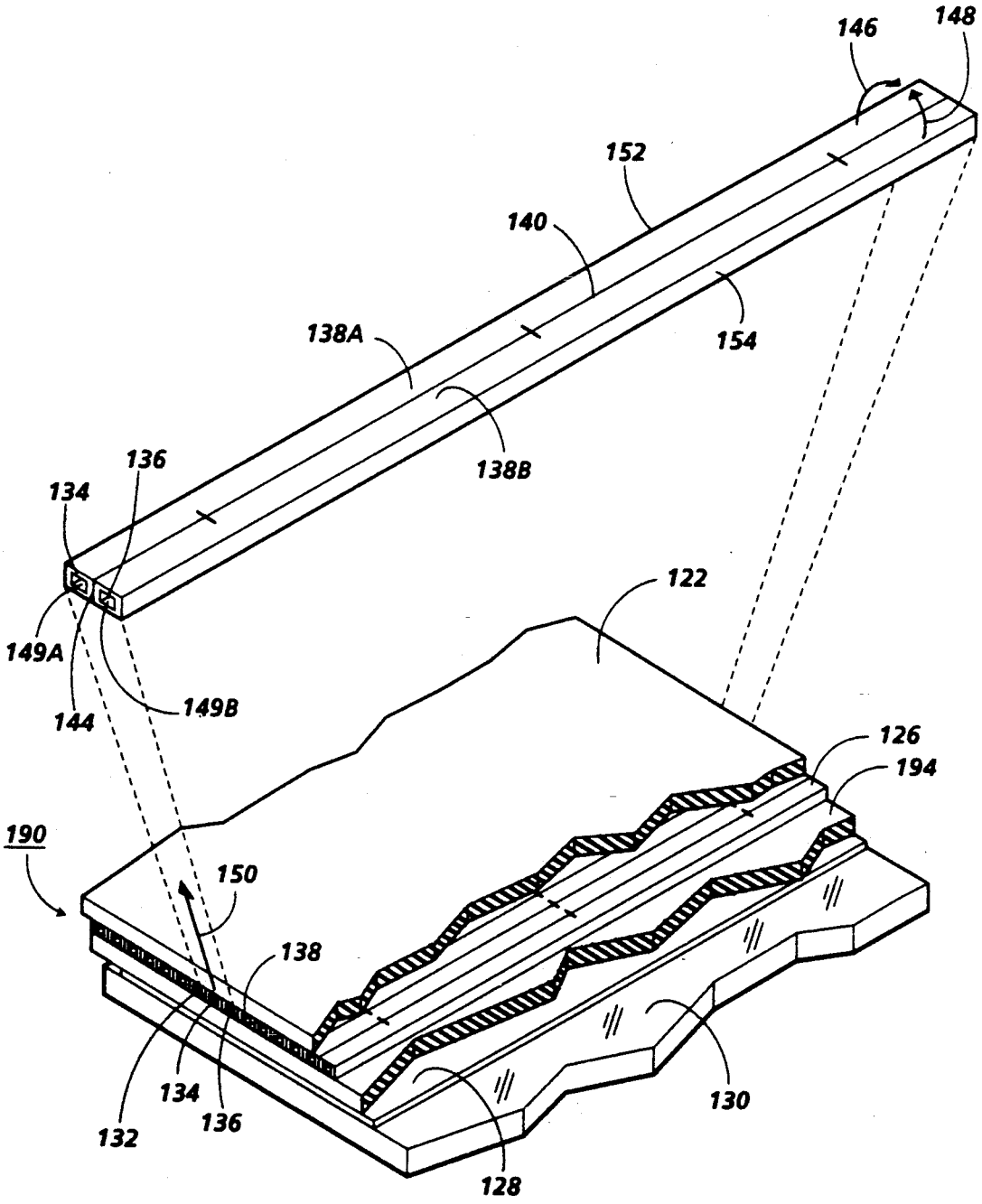
FIG. 3 illustrates an enlarged view of the platen belt in accordance with the present invention.

For a general understanding of the features of the present invention, reference is made to the drawings. In the drawings, like reference numerals have been used throughout to identify identical elements. Referring to FIGS. 1, 2, and 3, there is shown an electrophotographic reproduction machine 5 composed of a plurality of programmable components and sub-systems which cooperate to carry out the copying or printing job.

Machine 5 employs a photoconductive belt 10. Belt 10 is entrained about stripping roller 14, tensioning roller 16, idler rollers 18, and drive roller 20. Drive roller 20 is rotated by a motor coupled thereto by suitable means such as a belt drive. As roller 20 rotates, it advances belt 10 in the direction of arrow 12 through the various processing stations disposed about the path of movement thereof.

Initially, the photoconductive surface of belt 10 passes through charging station A where two corona generating devices, indicated generally by the reference numerals 22 and 24 charge photoconductive belt 10 to a relatively high, substantially uniform potential. Next, the charged photoconductive belt is advanced through imaging station B. At imaging station B, a document handling unit 26 sequentially feeds documents from a stack of documents in a document stacking and holding tray into registered position on platen 28. A pair of Xenon flash lamps 30 mounted in the optics cavity illuminate the document on platen 28, the light rays reflected from the document being focused by lens 32 onto belt 10 to expose and record an electrostatic latent image on photoconductive belt 10 which corresponds to the informational areas contained within the document currently on platen 28. After imaging, the document is returned to the document tray via a simplex path when either a simplex copy or the first pass of a duplex copy is being made or via a duplex path when a duplex copy is being made.

The electrostatic latent image recorded on photoconductive belt 10 is developed at development station C by a magnetic brush developer unit 34 having three developer rolls 36, 38 and 40. A paddle wheel 42 picks up developer material and delivers it to the developer rolls 36, 38. Developer roll 40 is a cleanup roll while a magnetic roll 44 is provided to remove any carrier granules adhering to belt 10.

Following development, the developed image is transferred at transfer station D to a copy sheet. There, the photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10.

Following transfer, a conveyor 50 advances the copy sheet bearing the transferred image to fusing station E where a fuser assembly, indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to gate 64 which guides the sheet to either finishing station F or to duplex tray 66, the latter providing an intermediate or buffer storage for those sheets that have been printed on one side and on which an image will be subsequently printed on the second, opposed side thereof. The sheets are stacked in duplex tray 66 face down on top of one another in the order in which they are copied.

To complete duplex copying, the simplex sheets in tray 66 are fed, in seriatim, by bottom feeder 68 back to transfer station D via conveyor 70 and rollers 72 for transfer of the second toner powder image to the opposed sides of the copy sheets. The duplex sheet is then fed through the same path as the simplex sheet to be advanced to finishing station F.

Copy sheets are supplied from a secondary tray 74 by sheet feeder 76 or from the auxiliary tray 78 by sheet feeder 80. Sheet feeders 76, 80 are friction retard feeders utilizing a feed belt and take-away rolls to advance successive copy sheets to transport 70 which advances the sheets to rolls 72 and then to transfer station D.

A high capacity feeder 82 is the primary source of copy sheets. Tray 84 of feeder 82, which is supported on an elevator 86 for up and down movement, has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95 and rolls 72 move the sheet to transfer station D.

After transfer station D, photoconductive belt 10 passes beneath corona generating device 94 which charges any residual toner particles remaining on belt 10 to the proper polarity. Thereafter, a pre-charge erase lamp (not shown), located inside photoconductive belt 10, discharges the photoconductive belt in preparation for the next charging cycle. Residual particles are removed from belt 10 at cleaning station G by an electrically biased cleaner brush 96 and two de-toning rolls 98 and 100.

With reference to FIG. 2, the document handler is provided with a document tray 5 adapted for supporting a stack of documents 7 face up. The document is then fed by take-away roll pair through document guide 13 to feed-roll pair 15 and under platen belt 17 onto the platen of the copy machine for reproduction. After exposure of the document it is fed off the platen by belt 17 into guide 19 and feed-roll pairs 21 and 23 either to an inverter mechanism 25 or back to the document stack through the feed-roll pair 27. A divertor 29 is provided to divert the document either to the inverter or to the feed roll pair 27. The platen belt 17 is entrained about rolls 31 and 33 for moving documents on and off platen 3, and is generally a one piece wide, flexible rubber belt or a plurality of narrow flexible rubber belts.

With reference to FIG. 3, there is shown an enlarged view of an improved platen belt in accordance with the present invention. In general, the platen belt shown at 120 includes an upper portion 122, and a lower portion 194, with a middle portion 126 sandwiched therebetween. A document original 128, is driven by the platen belt 120 into engagement with the platen glass 130. The top and bottom portions 122 and 124 are comprised of any suitable flexible belt material such as rubber. In accordance with the present invention, the middle portion 126 is a plurality or connecting or interlocking sections illustrated at 132, 134, 136 and 138.

An exploded view of sections 134 and 136 shows each of the sections 134 and 136 rectangular in shape with top portions 138A, and 138B respectively joined at the top along line 140. Each of the sections also has a rectangular end portion 149A and 149B respectively joining at line or leg 144. Preferably, the only engagement between the sections 134 and 136 is the pivot or hinge point along line 140. Section 134 is allowed free movement in the clockwise direction illustrated by arrow 146 about the line 140, and the section 136, allowed rotation in the counterclockwise direction along in the direction of arrow 148 about the line 140. Preferably, no other portion of the sections 134 or 136 are joined.

Thus, pressure upwardly from the original 128 in the direction of the arrow 150, will tend to push along the line 140 in a force contrary to the direction of the arrows 146 and 148. In other words, the force of a wrinkled or folded document pushing up against the bottom section 194 will cause the pressure or force to be distributed evenly along the bottom surfaces of the sections 134 and 136 and the interlocked top sections of each of the tubes will provide a counter pressure against the movement of the document upwardly. As will be understood, with reference to FIG. 3, the tendency of section 134 to rotate about the line 140 is also counter resisted by the same tendency of section 134 to rotate in the opposite direction along the line 152 joining section 134 with section 132. In a similar manner the tendency of section of 136 to rotate about line 140, is counter opposed by the same tendency of that section to rotate in the opposite direction about line 154 joining section 136 with section 138. This interlocking or "hinged" effect prevents the original from locally lifting up off the platen belt, thus holding the original flat on a platen glass.

Figure 4:
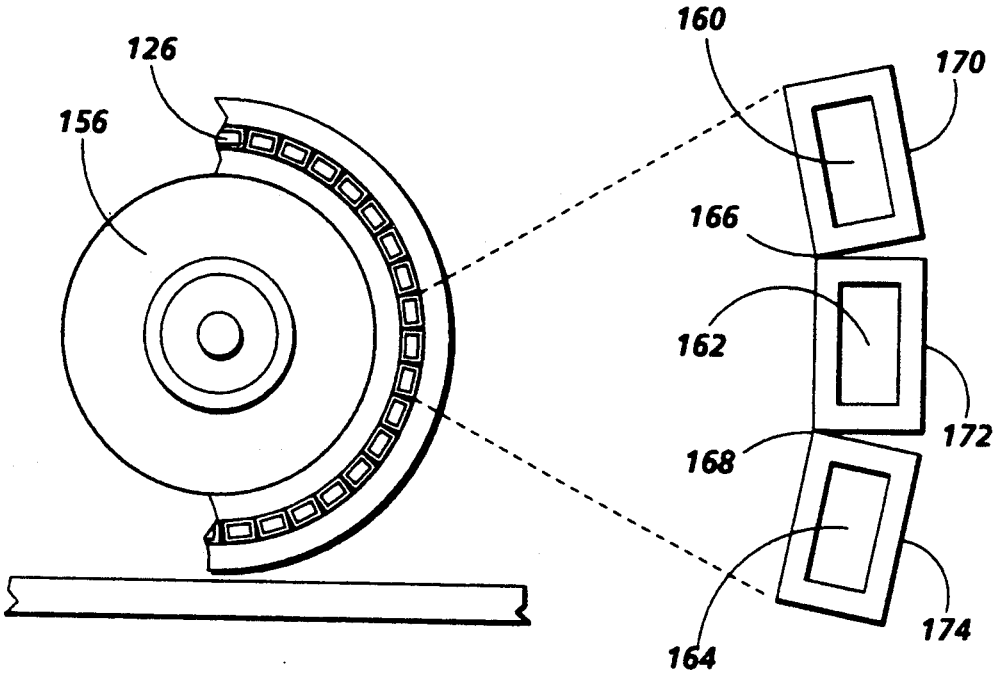
FIG. 4 is another view of the platen belt in accordance with the present invention.

FIG. 4, illustrates the platen belt 120 rotating about roller 156, the individual hinged or interlocking tubes 126 tending to freely flex in movement about the roller 156. As illustrated by the enlarged sections 160, 162 and 164, as the belt rotates about the roller 156, the interlocking portions 166 and 168 are located nearest the roller 156 as opposed to the bottom portions illustrated at 170, 172, and 174. Thus, as the belt rolls around the roller 156, the hinged sections 160, 162 and 164 tend to freely separate about the hinged points 166 and 168 to allow easy flexing and easy movement about the roller 156. Thus, the belt is easily flexible and pliable in a first direction in order to freely rotate about a roller, and yet is rigid and inflexible in a second direction, in the direction of an original document on the platen glass pushing up against the platen belt 120. As seen in FIG. 3, with the connected portion at the top or furtherest away from the point of pressure, there is a resistance to the movement. However, with the hinged portion nearer to the pressure point as illustrated in FIG. 4, that is the point nearest to the engagement with the roller 156, there is easy flexibility and freedom of movement. It should be noted that the interlocking tubes 126, can be any material such as plastic or metal, and that the sections need not be hollow but could be solid as well. The essential point is that there be a flat portion of engagement illustrated at line 144 in FIG. 3. In order to provide the counter force at opposite sides of each section. Preferably, the number of tubes or sections should be sufficiently high to provide an easy roll over the roller.

While the invention has been described with reference to the structure disclosed, it is not confined to the details set forth, but is intended to cover such modifications or changes as may come within the scope of the following claims.

I claim:

1. In an apparatus for feeding document sheets seriatim to an exposure station of a copier for exposure, including support means for receiving and holding a plurality of document sheets, a belt transport for removing the sheets sequentially from the support means and for returning the removed sheets to the support means following exposure at the exposure station, the belt transport supported on transport support rolls, the belt transport comprising:

a top layer of flexible material, a bottom layer of flexible material, the top layer and the bottom layer adapted for rotating about said transport support rolls, and a layer of tubes sandwiched between the top layer and the bottom layer, the layer of tubes interlocking along a predetermined plane to provide rigidity to the belt transport in a first direction and flexibility to the belt transport in a second direction.

2. The belt transport of claim 1 wherein the layer of tubes is a plurality of rectangularly shaped tubes interconnected at the corners along a common plane.

3. Sheet handling apparatus for transporting sheets to and from a flat surface comprising an endless belt movably supported around at least two support members to define a belt transport run across and parallel to said flat surface, said endless belt comprising a top and bottom layer of flexible material, and a layer of tubes sandwiched between the top layer and the bottom layer, the layer of tubes interlocking along a predetermined plane to provide rigidity to the belt transport in a first direction and flexibility to the belt transport in a second direction.

* * * * *